US009845711B2

(12) United States Patent
Ernst et al.

(10) Patent No.: US 9,845,711 B2
(45) Date of Patent: Dec. 19, 2017

(54) WASTE HEAT RECOVERY SYSTEM

(71) Applicant: CUMMINS INC., Columbus, IN (US)

(72) Inventors: Timothy C. Ernst, Columbus, IN (US); James A. Zigan, Versailles, IN (US)

(73) Assignees: Cummins Inc., Columbus, IN (US); PACCAR, Inc., Bellevue, WA (US)

( * ) Notice: Subject to any disclaimer, the term of this patent is extended or adjusted under 35 U.S.C. 154(b) by 770 days.

(21) Appl. No.: 13/902,719

(22) Filed: May 24, 2013

(65) Prior Publication Data

US 2014/0345274 A1 Nov. 27, 2014

(51) Int. Cl.

| | |
|---|---|
| ***F01D 15/12*** | (2006.01) |
| ***F04D 29/00*** | (2006.01) |
| ***F01D 25/18*** | (2006.01) |
| ***F04D 29/12*** | (2006.01) |
| ***B01D 19/02*** | (2006.01) |
| ***F01B 31/10*** | (2006.01) |
| ***F01K 9/00*** | (2006.01) |
| ***F01K 25/04*** | (2006.01) |
| ***F01K 25/06*** | (2006.01) |

(52) U.S. Cl.

CPC ..... *F01K 9/00* (2013.01); *F01K 25/04* (2013.01); *F01K 25/06* (2013.01)

(58) Field of Classification Search

CPC ..... F01K 25/06; F01D 25/18

USPC ..... 60/646, 657, 624; 415/122.1, 168.1, 415/168.2, 164.4, 169.1; 184/6.12

See application file for complete search history.

(56) References Cited

U.S. PATENT DOCUMENTS

| | | | | |
|---|---|---|---|---|
| 3,232,052 | A | 2/1966 | Ricard | |
| 3,670,850 | A * | 6/1972 | Swearingen | F16N 39/002 184/6.23 |
| 3,789,804 | A | 2/1974 | Aguet | |
| 3,867,056 | A * | 2/1975 | Carle | F04D 1/06 415/169.1 |
| 4,009,587 | A | 3/1977 | Robinson, Jr. et al. | |
| 4,164,850 | A | 8/1979 | Lowi, Jr. | |
| 4,204,401 | A | 5/1980 | Earnest | |
| 4,232,522 | A | 11/1980 | Steiger | |

(Continued)

FOREIGN PATENT DOCUMENTS

| | | |
|---|---|---|
| EP | 1 273 785 B1 | 5/2007 |
| JP | 60-222511 A | 11/1985 |

(Continued)

*Primary Examiner* — Mark Laurenzi
*Assistant Examiner* — Deming Wan
(74) *Attorney, Agent, or Firm* — Foley & Lardner LLP

(57) ABSTRACT

A waste heat recovery system includes a Rankine cycle (RC) circuit having a pump, a boiler, an energy converter, and a condenser fluidly coupled via conduits in that order, to provide additional work. The additional work is fed to an input of a gearbox assembly including a capacity for oil by mechanically coupling to the energy converter to a gear assembly. An interface is positioned between the RC circuit and the gearbox assembly to partially restrict movement of oil present in the gear assembly into the RC circuit and partially restrict movement of working fluid present in the RC circuit into the gear assembly. An oil return line is fluidly connected to at least one of the conduits fluidly coupling the RC components to one another and is operable to return to the gear assembly oil that has moved across the interface from the gear assembly to the RC circuit.

20 Claims, 4 Drawing Sheets

(56) References Cited

U.S. PATENT DOCUMENTS 4,267,692 A 5/1981 Earnest
4,271,664 A 6/1981 Earnest
4,363,216 A * 12/1982 Bronicki ..... F01D 25/22 184/6.22
4,428,190 A 1/1984 Bronicki
4,458,493 A 7/1984 Amir et al.
4,581,897 A 4/1986 Sankrithi
4,630,572 A 12/1986 Evans
4,831,817 A 5/1989 Linhardt
4,873,829 A 10/1989 Williamson
4,911,110 A 3/1990 Isoda et al.
5,121,607 A 6/1992 George, Jr.
5,207,188 A 5/1993 Hama et al.
5,421,157 A 6/1995 Rosenblatt
5,649,513 A 7/1997 Kanda
5,685,152 A 11/1997 Sterling
5,771,868 A 6/1998 Khair
5,806,322 A 9/1998 Cakmakci et al.
5,915,472 A 6/1999 Takikawa et al.
5,950,425 A 9/1999 Takahashi et al.
6,014,856 A 1/2000 Bronicki et al.
6,035,643 A 3/2000 Rosenblatt
6,055,959 A 5/2000 Taue
6,128,905 A 10/2000 Fahlsing
6,138,649 A 10/2000 Khair et al.
6,301,890 B1 10/2001 Zeretzke
6,321,697 B1 11/2001 Matsuda et al.
6,324,849 B1 12/2001 Togawa et al.
6,393,840 B1 5/2002 Hay
6,494,045 B2 12/2002 Rollins, III
6,523,349 B2 2/2003 Viteri
6,571,548 B1 6/2003 Bronicki et al.
6,598,397 B2 7/2003 Hanna et al.
6,606,848 B1 8/2003 Rollins, III
6,637,207 B2 10/2003 Konezciny et al.
6,701,712 B2 3/2004 Bronicki et al.
6,715,296 B2 4/2004 Bakran et al.
6,745,574 B1 6/2004 Dettmer
6,748,934 B2 6/2004 Natkin et al.
6,751,959 B1 6/2004 McClanahan et al.
6,792,756 B2 9/2004 Bakran et al.
6,810,668 B2 11/2004 Nagatani et al.
6,817,185 B2 11/2004 Coney et al.
6,848,259 B2 2/2005 Kellner-Sornig et al.
6,877,323 B2 4/2005 Dewis
6,880,344 B2 4/2005 Radcliff et al.
6,910,333 B2 6/2005 Minemi et al.
6,964,168 B1 11/2005 Pierson et al.
6,977,983 B2 12/2005 Correia et al.
6,981,377 B2 * 1/2006 Vaynberg ..... F01K 25/08 60/641.11
6,986,251 B2 1/2006 Radcliff et al.
7,007,487 B2 3/2006 Belokon et al.
7,028,463 B2 4/2006 Hammond et al.
7,044,210 B2 5/2006 Usui
7,069,884 B2 7/2006 Baba et al.
7,117,827 B1 10/2006 Hinderks
7,121,906 B2 10/2006 Sundel
7,131,259 B2 11/2006 Rollins, III
7,131,290 B2 11/2006 Taniguchi et al.
7,159,400 B2 1/2007 Tsutsui et al.
7,174,716 B2 2/2007 Brasz et al.
7,174,732 B2 2/2007 Taniguchi et al.
7,191,740 B2 3/2007 Baba et al.
7,200,996 B2 4/2007 Cogswell et al.
7,225,621 B2 6/2007 Zimron et al.
7,281,530 B2 10/2007 Usui
7,325,401 B1 2/2008 Kesseli et al.
7,340,897 B2 3/2008 Zimron et al.
7,454,911 B2 11/2008 Tafas
7,469,540 B1 12/2008 Knapton et al.
7,578,139 B2 8/2009 Nishikawa et al.
7,665,304 B2 2/2010 Sundel
7,721,552 B2 5/2010 Hansson et al.
7,797,940 B2 9/2010 Kaplan
7,823,381 B2 11/2010 Misselhorn
7,833,433 B2 11/2010 Singh et al.
7,866,157 B2 1/2011 Ernst et al.
7,942,001 B2 5/2011 Radcliff et al.
7,958,873 B2 6/2011 Ernst et al.
7,997,076 B2 8/2011 Ernst
8,820,082 B2 * 9/2014 Yoshimura ..... F01K 25/06 418/201.1
2002/0099476 A1 7/2002 Hamrin et al.
2003/0033812 A1 2/2003 Gerdes et al.
2003/0213245 A1 11/2003 Yates et al.
2003/0213246 A1 11/2003 Coll et al.
2003/0213248 A1 11/2003 Osborne et al.
2005/0262842 A1 12/2005 Claassen et al.
2008/0289313 A1 11/2008 Batscha et al.
2009/0031724 A1 2/2009 Ruiz
2009/0090109 A1 4/2009 Mills et al.
2009/0121495 A1 5/2009 Mills
2009/0133646 A1 5/2009 Wankhede et al.
2009/0151356 A1 6/2009 Ast et al.
2009/0179429 A1 7/2009 Ellis et al.
2009/0188253 A1 * 7/2009 Smith ..... F01C 1/16 60/657
2009/0211253 A1 8/2009 Radcliff et al.
2009/0320477 A1 12/2009 Juchymenko
2009/0322089 A1 12/2009 Mills et al.
2010/0018207 A1 1/2010 Juchymenko
2010/0071368 A1 3/2010 Kaplan et al.
2010/0083919 A1 4/2010 Bucknell
2010/0139626 A1 6/2010 Raab et al.
2010/0180584 A1 7/2010 Berger et al.
2010/0192569 A1 8/2010 Ambros et al.
2010/0229525 A1 9/2010 Mackay et al.
2010/0257858 A1 10/2010 Yaguchi et al.
2010/0263380 A1 10/2010 Biederman et al.
2010/0282221 A1 11/2010 Le Lievre
2010/0288571 A1 11/2010 Dewis et al.
2011/0000552 A1 * 1/2011 Woolley ..... F01K 25/10 137/13
2011/0005237 A1 * 1/2011 Matteson ..... F01K 17/04 62/6
2011/0005477 A1 1/2011 Terashima et al.
2011/0006523 A1 1/2011 Samuel
2011/0094485 A1 4/2011 Vuk et al.
2011/0209473 A1 9/2011 Fritz et al.
2012/0023946 A1 2/2012 Ernst et al.

FOREIGN PATENT DOCUMENTS

JP 8-68318 A 3/1996
JP 9-32653 A 2/1997
JP 10-238418 A 9/1998
JP 11-166453 A 6/1999
JP 2005-36787 A 2/2005
JP 2005-42618 A 2/2005
JP 2005-201067 A 7/2005
JP 2005-329843 A 12/2005
JP 2007-332853 A 12/2007
JP 2008-240613 A 10/2008
JP 2009-167995 A 7/2009
JP 2009-191647 A 8/2009
JP 2010-77964 A 4/2010
WO 2009/098471 A2 8/2009

* cited by examiner

WASTE HEAT RECOVERY SYSTEM

STATEMENT REGARDING FEDERALLY SPONSORED RESEARCH OR DEVELOPMENT

This invention was made with government support under contract number DE-EE0003403-Recovery Act-System Level Demonstration of Highly Efficient and Clean, Diesel Powered Class 8 Trucks (SUPERTRUCK) awarded by the Department of Energy (DOE). The government has certain rights in the invention.

TECHNICAL FIELD

The technical field relates to waste heat recovery systems utilizing a Rankine cycle circuit coupled to a gear assembly, and more particularly, to returning oil present in the working fluid of the Rankine cycle circuit to the gear assembly.

BACKGROUND

A Rankine cycle (RC), such as an organic Rankine cycle (ORC), can capture a portion of heat energy that normally would be wasted ("waste heat") and convert a portion of the captured heat energy into energy that can perform useful work. Systems utilizing an RC are sometimes called waste heat recovery (WHR) systems. For example, heat from an internal combustion engine system, such as exhaust gas heat energy or other engine waste heat sources (e.g., engine oil, charge gas, engine block cooling jackets) can be captured and converted to useful energy (e.g., electrical and/or mechanical energy). In this way, a portion of the waste heat energy can be recovered to increase the efficiency of a system including one or more waste heat sources.

SUMMARY

The present disclosure relates to a waste heat recovery (WHR) system including Rankine cycle (RC) circuit coupled to a gear assembly, and to returning oil that has migrated into the RC circuit from the gear assembly back to the gear assembly.

In an aspect of the disclosure, a WHR system includes an RC circuit having a boiler fluidly connected to a pump downstream of the pump, an energy converter fluidly connected to the boiler downstream of the boiler, a condenser fluidly connected to the energy converter downstream of the energy converter and fluidly connected to the pump upstream of the pump, each fluid connection between the boiler, pump, energy converter and condenser comprising a conduit. A gear assembly is mechanically coupled to the energy converter of the RC circuit and includes a capacity for oil. An interface is positioned between the RC circuit and the gearbox assembly and is configured to partially restrict movement of oil present in the gear assembly into the RC circuit and to partially restrict movement of working fluid vapor present in the RC circuit into the gear assembly. An oil return line is fluidly connected to at least one of the conduits and is operable to return to the gear assembly oil that has moved across the interface from the gear assembly to the RC circuit.

DETAILED DESCRIPTION

The present disclosure provides a waste heat recovery (WHR) system including a Rankine cycle circuit, gearbox assembly, and lubrication oil/working fluid separation system that separates and collects oil accumulated in the working fluid of the organic Rankine cycle and prevents excessive amount of oil from accumulating in the working fluid and returns the separated oil to the gearbox assembly. Exemplary embodiments of the WHR system will be described herein. Identical or similar elements, parts or components are provided with the same reference number in all drawings. However, the disclosure should not be construed as being limited to these embodiments. Rather, these embodiments are provided as examples so that the disclosure will be thorough and complete, and will fully convey its scope to those skilled in the art. Descriptions of well-known functions and constructions may not be provided for clarity and conciseness.

Figure 1:
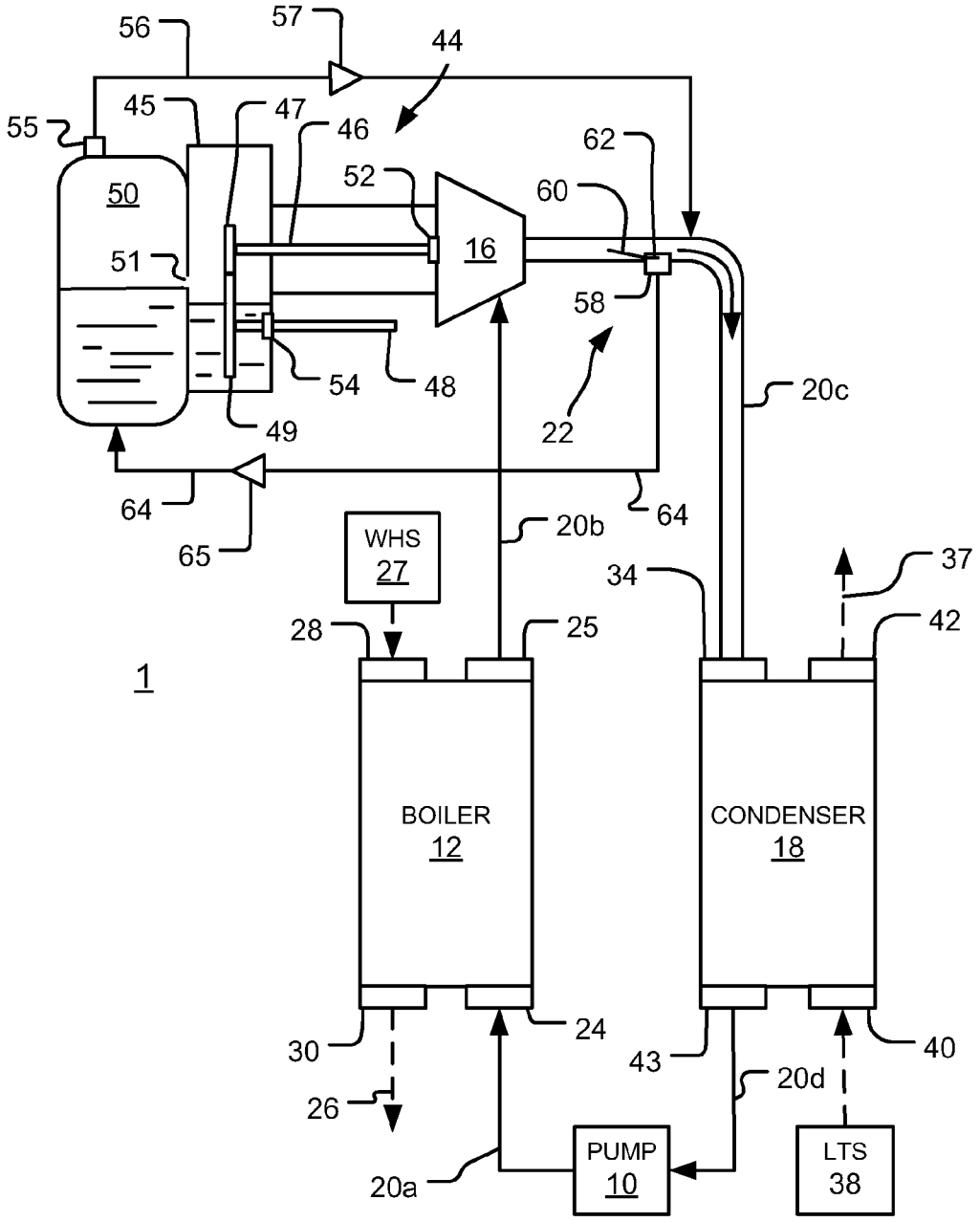
FIG. 1 is a diagram of a waste heat recovery system including an oil scraper positioned after an outlet of an energy converter according to an exemplary embodiment.

FIG. 1 is a diagram of a WHR system 1 utilizing a lubrication oil/working fluid separation system according to an exemplary embodiment. The WHR system 1 includes a Rankine cycle, which can increase the thermal efficiency of an internal combustion engine, for example, of a gasoline or diesel engine system, by utilizing internal combustion exhaust gas heat energy and/or heat energy generated by an exhaust aftertreatment system. More specifically, WHR system 1 includes a pump 10 (e.g., a feed or liquid pump) configured to move working fluid through a circuit including a boiler 12, an energy converter 16, which can be a high pressure expander (e.g., a turbine), and a condenser 18. Pump 10, boiler 12, energy converter 16, and condenser 18 are fluidly connected via conduits 20*a*-20*d* to form a Rankine cycle circuit using conduits shown as solid black arrows in FIG. 1 except for conduit 20*c* fluidly connecting energy converter 16 to condenser 18. Conduit 20*c* is depicted in cross sectional view and includes an oil scraper 22, which is described later in detail.

Boiler 12 includes one or more working fluid passageways (not shown) between boiler inlet 24 and outlet 25. Each working fluid passageway is in thermal communication with heated fluid 26 of a waste heat source (WHS) 27 (e.g., exhaust gas) flowing through one or more coolant passageways (not shown) fluidly separate from any working fluid passageway, between an inlet 28 and an outlet 30 of boiler 12. In boiler 12, heat from heated fluid 26 is transferred to the working fluid, which causes the working fluid to boil off and produce a high pressure vapor.

Energy converter 16 is capable of producing additional work or transferring energy to another device or system. For example, energy converter 16 may be a turbine, piston, scroll, screw, vane, swash plate, or other type of gas expander that moves, e.g., rotates, as a result of expanding working fluid vapor to provide additional work. The additional work can be fed into the engine's driveline to supplement the engine's power either mechanically, hydraulically or electrically (e.g., by turning a generator), or it can be used to drive a generator and power electrical devices, parasitics or a storage battery (not shown). Alternatively, energy converter 16 can be used to transfer energy from one system to another system (e.g., to transfer heat energy from the waste heat recovery system to another engine system requiring shaft work such as a compressor, alternator, A/C compressor, etc. or to a fluid for a heating system).

Energy converter 16 operates by receiving the high pressure vapor of the working fluid from boiler 12 and converting the energy of the high pressure vapor into another useful form of energy to provide the additional work. The working fluid exiting the outlet of energy converter 16 is an expanding gas vapor that flows through conduit 20*c* to an inlet 34 of condenser 18. After entering the condenser inlet 34, the working fluid flows through one or more passageways (not shown) of the condenser 18 that are in thermal communication with a cooling medium such as coolant or air 37 flowing from a low temperature source (LTS) 38 into one or more passageways (not shown) between inlet 40 and outlet 42 of condenser 18. Heat is transferred in condenser 18 from the working fluid vapor to the cooling medium, which cools and condenses the working fluid vapor to liquid form before exiting the condenser at an outlet 43. LTS 38 can be, for example, part of a liquid cooling loop including a condenser cooler (not shown) and a condenser cooler pump (not shown), a glycol cooling loop, and/or a system in which working fluid is directly cooled with an air-cooled heat exchanger (e.g., ram air). The condensed and cooled working fluid is provided at a lower pressure to pump 10, which increases the working fluid pressure to repeat the Rankine cycle.

The working fluid can be an organic working fluid, such as Genetron™ R-245fa from Honeywell, Therminol™, Dowtherm J from the Dow Chemical Co., Fluorinol, Toluene, dodecane, isododecane, methylundecane, neopentane, neopentane, octane, or water/methanol mixtures, or steam in a non-organic RC embodiment), for example. In the boiler 12, the working fluid boils off and produces a high pressure vapor that exits the boiler outlet 16 and flows to an inlet of an energy converter 22, While not shown, the WHR system 1 or any other embodiment consistent with the present disclosure can include other components, for example, a superheater provided with boiler 12, a recuperator that transfers heat from working fluid from the outlet of energy converter 16 to cooled working fluid between pump 10 and boiler 12, one or more receivers, and/or one or more other components. Additionally, a WHR system consistent with the present disclosure can include pressure, temperature, fluid flow and/or speed sensors (not shown), for example, pressure and/or temperature sensors can be positioned at or near the inlet and/or outlet of each of the pump 10, boiler 12, energy converter 16, and condenser 18 to monitor the status and performance of various aspects of the system. Signals provided by these sensors can be received by a controller device, such as an engine control module (ECM), which can control one or more components of the WHR system or an engine system based on the received signals.

Power produced by energy converter 16 is capable of producing additional work or transferring energy to another device or system. In WHR system 1, power of the energy converter 16 is mechanically coupled to a gear assembly 44, which in turn is mechanically fed to a driveline (not shown) to supplement engine power and improve fuel economy. The power output of the energy converter 16 also can be used to perform other mechanical or electrical work, for example, turning a generator, power electrical devices, parasitics, charge a storage battery (not shown), or transfer energy from system to another system (e.g., to transfer heat energy from WHR system 1 to a fluid for a heating system).

Gear assembly 44 includes a gearbox 45 that houses gears 47 and 49 respectively attached to an input shaft 46 and an output shaft 48, associated bearing assemblies (not shown), and an oil reservoir 50 that is in fluid communication with the gearbox 45. While the oil reservoir 50 is shown in the exemplary embodiments as laterally adjacent the gearbox assembly 44, oil reservoir 50 can be located in another position. For example, oil reservoir 50 can be located below the gearbox 45 so oil can fall down to it. As shown in the exemplary configuration of FIG. 1, a weir 51 is provided across the lower portion of the gearbox 45 to hold the oil on the oil tank side and prevent the gear from constantly sloshing through liquid oil. There also can be provided collectors/scrapers on the walls of the gearbox 45 (not shown) that direct the oil that collects due to the spinning vapor inside the gearbox 45 toward weir 51 and over it to the oil reservoir side to reduce how much the oil interacts with the spinning gear.

In an embodiment, a rotational speed of output shaft 48 is reduced relative to the rotational speed of input shaft 46 and a torque at output shaft 48 is increased relative to a torque at the input shaft 46 in a manner corresponding to a reduction ratio of the gearbox 45. It is to be understood that gearbox 45 can include a different number of gears than what is depicted in the figures herein and an output to input ratio corresponding to a particular application of the converted power.

Gearbox 45 includes an input shaft seal 52 and an output shaft seal 54. Input shaft seal 52 forms an interface that operates more as a flow restriction device that partially restricts movement of oil present in gear assembly 44 into the RC circuit and partially restricts movement of working fluid present in the RC circuit into gear assembly 44. That is, input shaft seal 52 it is not a perfect seal. In an embodiment where gearbox 45 has a reduction ratio between input shaft 46 and output shaft 48, input shaft seal 52 is a high speed input shaft/energy converter interface and output shaft seal 54 is a low speed and a more perfect seal. The imperfect seal 52 allows for lubricating any of the moving parts in the system such as the pump 10, the valves etc. The less than perfect input shaft seal 52 allows oil from gearbox 45 to cross the interface of high speed input shaft seal 52 from gearbox 45 to energy converter 16, and working fluid vapor in energy converter 16 to cross the interface of high speed input shaft seal 52 from energy converter 16 to gearbox 45 during various engine operating conditions. For instance, low-side pressure at the energy converter 16 can fluctuate rapidly during engine transients and cause pressure gradients where oil can escape the gearbox 45 and enter the Rankine cycle circuit through input shaft seal 52.

A vapor vent 55 is also provided to vent the gear assembly 44 at times where the gearbox pressure is higher than the pressure at outlet of energy converter 16 to return working fluid vapor in gear assembly 44 to the Rankine cycle circuit when the gear assembly 44 is at a higher pressure compared with pressure in conduit 20*c* at the discharge from energy converter 16. A return line 56 including a check valve 57 to prevent back flow of working fluid vapor into the gearbox when the energy converter outlet is at a higher pressure. Vapor vent 55, return line 56 and check valve 57 allow for a "clean vapor" vent location from the oil tank rather than pushing oil and working fluid vapor out the input shaft seal 52. This can occur during a considerable amount of operating points, for example, due to the pumping action of a turbine wheel that creates a lower pressure inside the gearbox 45 compared with the pressure at the turbine outlet. If working fluid vapor were allowed to vent into gearbox 45, there would be a continuous flow of oil/working fluid vapor out the input shaft seal 52.

In addition to crossing the boundary of the high speed input shaft seal 52 from gearbox 45 to energy converter 16, oil in the form of oil mist can leave gear assembly 44 via vent 55 and vent line 56 along with the working fluid vapor returning to the Rankine circuit. As a result, oil can accumulate in the working fluid and decrease the system performance. For example, an oil film can form on components of the Rankine cycle circuit and reduce heat transfer in the heat exchangers, i.e., boiler 12 and condenser 18. Additionally, excessive loss of oil in the gearbox 45 can lead to insufficient lubrication of gearbox moving parts. Further, in embodiments using a turbine as an energy converter 16, oil can reduce the turbine work due to momentum transfer of the liquid oil droplets onto turbine blades (not shown). Oil droplets can also cause damage to turbine blades over sustained periods of time.

In the present embodiment, WHR system 1 includes an oil scraper type oil return system that separates gearbox oil from the working fluid to keep an excessive amount of gearbox oil from accumulating in the working fluid of the Rankine cycle circuit and returns the oil to the gear assembly 44. The oil return system in the present embodiment utilizes oil scraper 22 provided on the conduit 20*c* leading from the outlet of energy converter 16 to condenser 18. Oil scraper 22 includes an oil collector 58 and at least one channeling structure 60, such as a gutter, groove or obstruction that collects oil impacting the wall of the conduit 21 and provides a channel or path to direct the collected oil to an opening 62 on oil collector 58. The opening 62 can be, for example, at least one slit pointed into the direction of working fluid vapor flow. Each channeling structure 60 preferably leads to the opening such that it substantially lines up with a component of the vapor flow direction in conduit 20*c*. Oil that has traveled to the outlet of energy converter 16 tends to impact the wall of conduit 20*c* due to rotation of the turbine wheel/refrigerant vapor.

The oil collector 58 of oil scraper 22 has a positive pressure gradient because conduit 20*c* is often at a greater total pressure, i.e., static plus dynamic pressure, compared with the static pressure of gear assembly 44. Oil that impacts the wall of conduit 20*c* and is collected by channeling structure 60 and oil collector 58 is drained back to the gear assembly 44 via an oil return line 64 and check valve 65 provided between collector 58 and oil reservoir 50. While the embodiment shown in FIG. 1 returns oil collected by oil scraper 22 to the oil reservoir 50 or gearbox 45 in a passive manner. There is always some flow of refrigerant vapor back to the oil reservoir and that is acceptable because the vapor vent 55 allows that refrigerant vapor to travel back to the refrigerant circuit. The oil return line is of sufficiently small diameter because the return oil rate of flow is not appreciably high, and thus restricts how much refrigerant vapor travels back to the gearbox assembly 44 since there is fairly low dP to drive the vapor that direction along with a small diameter return line.

Oil that gets past oil scraper 22 travels on to condenser 18 where it mixes with the liquid working fluid. A POE oil (Polyolester oil) that is miscible with the working fluid can be used as the gearbox lubricant, although other miscible oils could be used. While it is possible to use non-miscible oils in some embodiments, miscible oils provide the advantage not separating out in locations of the system where it provides advantageous effects. Any oil in the working fluid is pumped through the Rankine circuit and is eventually separated from the working fluid as the working fluid boils/vaporizes in the boiler 12. The liquid oil remaining tends to wet the walls of the conduit where the working fluid vapor is present and is eventually carried through to the outlet of energy converter 16 (e.g., an outlet of a turbine). Oil also can arrive at the outlet of energy converter 16 due to pressure gradients across the input shaft seal 52 during engine transients. Additionally, with a turbine as energy converter 16, during operation at light to moderate load where the pumping action of the turbine wheel is greater than the flow dynamics at the face of the turbine wheel. Any oil that comes out the input shaft seal 52 ends up at the conduit 20*c*.

Figure 2A:
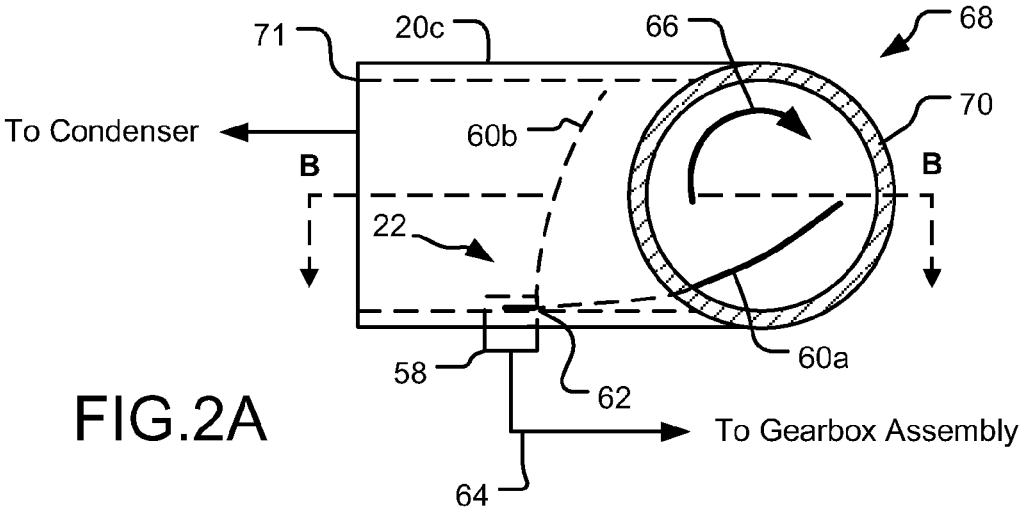
FIG. 2A is a diagram showing a section of a working fluid conduit including a bend and an oil scraper.
Figure 2B:
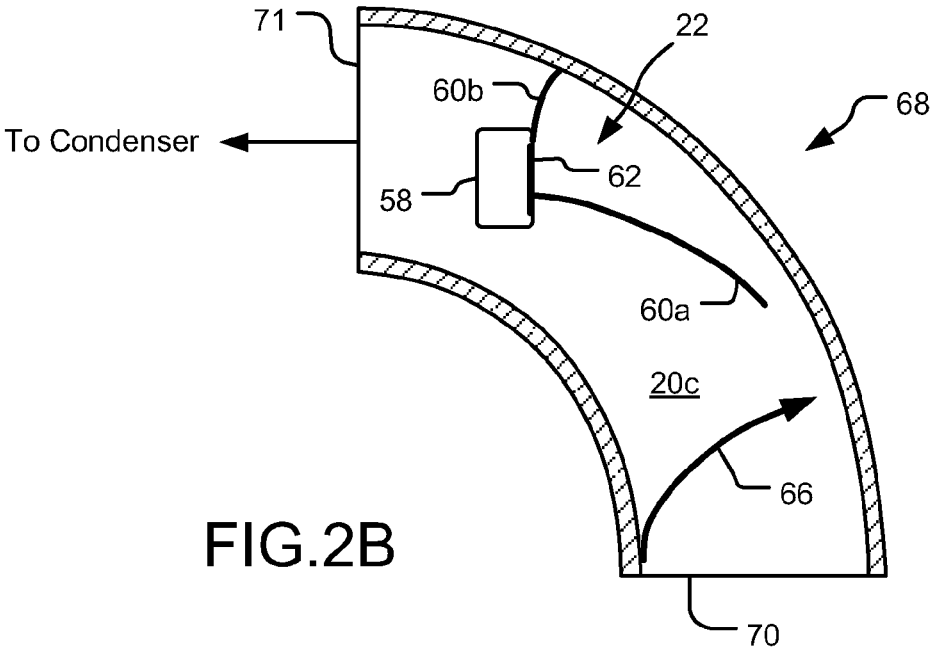
FIG. 2B is a diagram of a cross section taken across section B-B of the working fluid conduit shown in FIG. 2A.

To further enhance impact of the oil onto the wall of conduit 20*c*, oil scraper 22 can be positioned at or near a bend in conduit 20*c*. FIGS. 2A and 2B show a portion of conduit 20*c* including a bend portion 68 and oil scraper 22 according to an exemplary modification of the embodiment shown in FIG. 1.

In bend portion 68, working fluid downstream of boiler 12 (see FIG. 1) flows into end shown in cross section facing in a direction normal to the drawing sheet. Arrow 66 indicates direction of flow of the working fluid in conduit 20*c* as the working fluid flows from one end 70 to the other end 71 of bend portion 68. In an embodiment in which energy converter 16 includes a turbine, the flow direction 66 can include both rotational and tangential components as can be seen in FIGS. 2A and 2B. Embodiments may not include a turbine and/or rotational movement as depicted in FIGS. 2A and 2B at the output of the energy converter. For instance, even the turbine expander when running ideally can have little or no flowing vapor rotation at the outlet. In any event, the oil scraper 22 can work in such a scenario because the oil will coalesce even due to gravity or will impact the wall as flowing vapor changes direction going around the bend in the conduit 20*c*.

As the working fluid vapor advances through the bend portion 68, liquid oil in the flow tends to wet the inner wall of conduit 20*c* from the rotational flow of the working fluid vapor and the bend portion 68 causes oil to impact the wall of conduit 20*c*. However, wall wetting would occur in other situations, for example, if conduit 20*c* is a straight section, due to gravity settling out the oil mist/droplets, or from the natural turbulence of the vapor as it moves down the pipe. Once the oil impacts the wall anywhere, it would tend to stay in contact with the wall due to surface tension of the oil. Also, the oil would tend to move toward the lowest point in the tube due to gravity and the oil's higher density than the working fluid vapor. Also, in a curve or other geometry change, the oil would tend to impact the wall and coalesce. In bend portion 68, channel structure 60 includes plural channels 60*a* and 60*b* provided on the inner wall of conduit 20*c*. Each channel 60*a*, 60*b* has one end distal to collector 58, another end proximate collector 58, and extends along a path in conduit 20*c* that intersects a tangential path of the working fluid vapor traversing the section of the conduit the channel. The channels 60*a*, 60*b* collect and guide oil on the inner wall of conduit 20*c* through opening 62 of oil collector 58 and into a storage volume of collector 58 where it is stored until being returned to gear assembly 44 via oil return line 64. Although FIGS. 2A and 2B show a channel structure 60 including two channels 60*a*, 60*b*, conduit 20*c* can include only one channel or more than two channels.

Figure 2C:
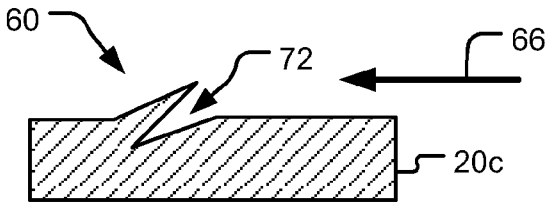
FIG. 2C is a diagram showing an enlarged view of a trapping channel of the oil scraper shown in FIGS. 2A and 2B.

FIG. 2C shows a cross section of a portion of conduit 20*c* in the vicinity of an exemplary channel structure 60 in a more detailed and enlarged view. Arrow 66 in FIG. 2C represents the rotational and translational flow components of the working fluid vapor shown in FIGS. 2A and 2B. Liquid oil in the working fluid vapor generally follows the directional path of the vapor, and that oil is collected by the channel (gutter) when a section of the channel forms an acute angle to zero angle with the direction of vapor flow (at that channel section). In addition, even without a gutter or channel feature, oil will tend to collect preferentially at the bottom of the tube. However, the angle of the channel can run in a way that the refrigerant vapor flow will cause it to efficiently collect in a single location for return back to the oil tank. Channel structure 60 includes a gutter 72 formed in the wall of conduit 20*c*, for example, by a stamping, cutting or casting method. In other embodiments, channel 60 can be formed as at least one slot, groove or other recess in the inner wall of conduit 20*c*, or as a protruding mesa or berm-like structure on the inner wall of conduit 20*c*.

Figure 3:
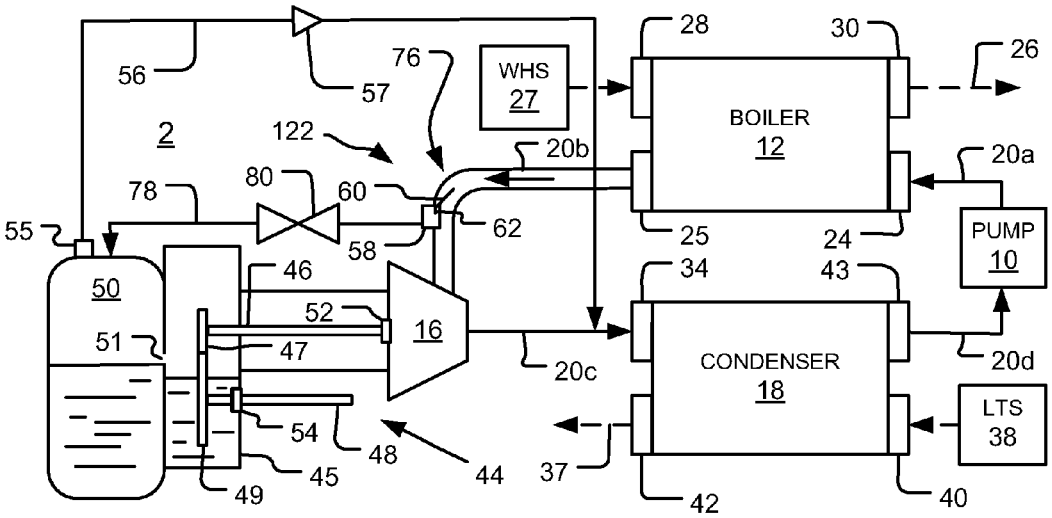
FIG. 3 is a diagram of a waste heat recovery system including an oil scraper positioned before an inlet of an energy converter according to an exemplary embodiment.

FIG. 3 is a diagram of a waste heat recovery system 2 according to an exemplary embodiment in which an oil scraper 122 is provided in conduit 20*b* on the inlet side, or upstream of energy converter 16. Channel structure 60 collects oil that wets the inner wall of conduit 20*b* from the working fluid vapor flowing from boiler 12 and guides the collected oil to opening 62 of collector 58. The present embodiment includes a bend 76 portion in conduit 20*b* such as the turn 68 shown in FIGS. 2A to 2C, but the direction of working fluid flow though the turn would include substantially less rotational flow components compared with flow direction 66, an end of bend portion 76 downstream from the collector 58 fluidly connects to energy converter 16, and the other end of bend portion 76 upstream from collector 58 fluidly connects to boiler 12. In the present embodiment, there would be no significant rotational components in the working fluid where the oil scraper is positioned before the energy converter (i.e., between boiler 12 and energy converter 16). To increase collection efficiency, a channel (or channels) to collect oil can be oriented in a conduit relative to a position of the collector inlet, for example, one or more channels in the shape of an inverted "V" with the collector at the apex/vertex or a lip or scraper toward the bottom side of the inner surface of conduit 20*b* to capture oil that has coalesced and is toward the bottom of the tube due to gravity. In other embodiments, collector 58 can be provided in at the bottom inner surface of a horizontal section of conduit 20*b* (not shown). An oil scraper drain line 78 is fluidly connected at one end thereof to collector 58 and at another end thereof to oil reservoir 50. Oil flow to the reservoir 50 is controlled via a flow control device 80 positioned in oil scraper drain line 78.

Flow control device 80 can be provided with an actuator (not shown in FIG. 3) to control the opening of flow control device 80 to allow oil in collector 58 to flow to oil reservoir 50. For example, flow control device 80 can be operated based on a signal of a pressure and/or temperature sensor at the inlet of energy converter 16, temperature of oil as measured by a temperature sensor at the oil reservoir or gearbox 45, or with detecting the presence of oil in collector 58 or detecting whether an oil level in collector 58 reached or exceeds a predetermined threshold, for example, by an optical or mechanical detector at the collector 58. Flow control device 80 can be operated at a predetermined interval, for example, based on time spent at a particular engine operating conditions. Flow control device 80 may also simply be an orifice to restrict the flow rate while still providing a return path for oil. When the oil concentration is low in the working fluid, there would be a small flow rate of vapor into the gearbox assembly 44, but this is acceptable due to gearbox assembly vent line 56 being substantially larger than the flow restriction orifice. If the oil temperature in the gearbox 45 is above a certain threshold, the valve 80 can be controlled not to open because the turbine inlet working fluid temperature would be high. If oil is returned during this point, the oil temperature in the oil tank could exceed a high temperature threshold set for the oil.

Figure 4:
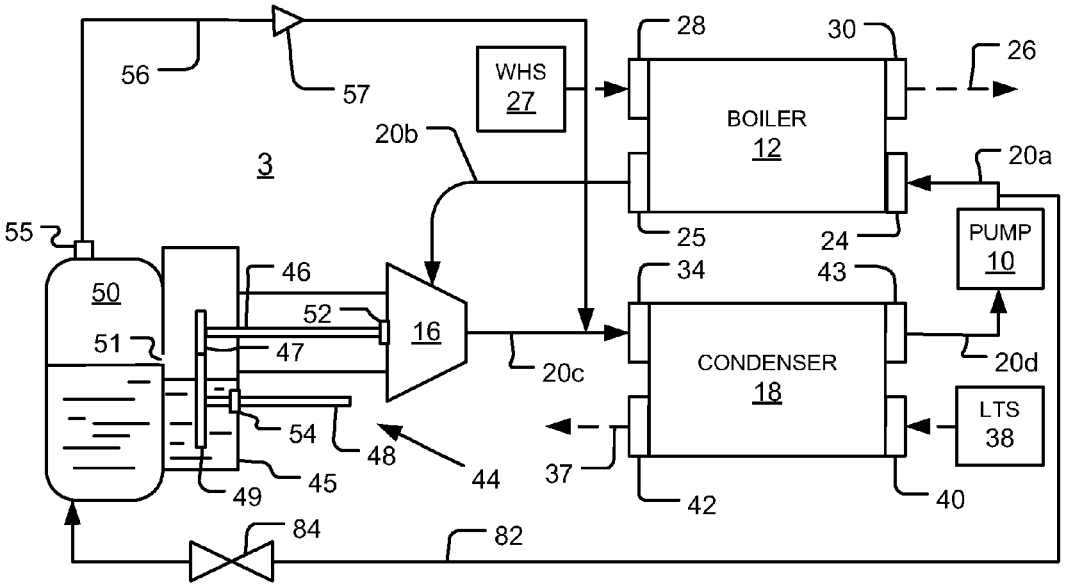
FIG. 4 is a diagram of a waste heat recovery system including controllably diverting amounts of working fluid/oil mixture output from a pump to gearbox oil according to an exemplary embodiment.

FIG. 4 is a diagram of a waste heat recovery system according to an exemplary embodiment, where amounts of working fluid/oil mixture output from a pump are controllably diverted to the gear assembly 44 via return line 82 and flow control device 84. The present embodiment allows oil in the gearbox to be cooled while also performing the function of oil return to the gear assembly 44. Oil separation occurs because the return of mixed oil and working fluid from line 82 enters the oil tank as a mixture, and then the working fluid boils off to a vapor while the oil stays in liquid form. The vaporized working fluid returns to the working fluid loop via the vapor vent 55 at the top of oil reservoir 50. The present embodiment allows oil in gear assembly 44 to be cooled while also performing the function of oil return to the gear assembly 44. As such, a need can be eliminated for a separate oil cooler that is cooled by engine coolant or another coolant. Flow control device 84 can be controlled based on oil temperature in oil reservoir, or it can be a restriction orifice in an application utilizing passive control.

Figure 5:
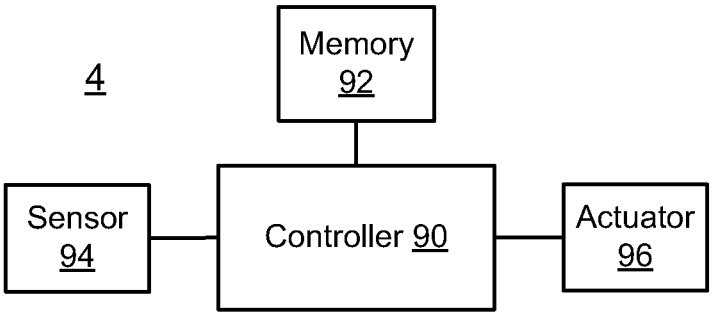
FIG. 5 is a diagram of a control system according to an exemplary embodiment.

FIG. 5 is a diagram of a control system 4 in accordance with an exemplary embodiment that can be implemented to provide a control function with embodiments according to the present disclosure. For example, control system 4 can be utilized to implement the control functions of flow control devices 80 and 84 described above.

Control system 4 includes a controller 90, which is operable to perform one or more sequences of actions by elements of controller 90, which can be a computer system or other hardware capable of executing programmed instructions, for example, a general purpose computer, special purpose computer, workstation, or other programmable data processing apparatus. Controller 90 is in communication with memory 92, which can store code related to the programmed instructions carried out by controller 90. In some embodiments, controller 90 and memory 92 can be an ECM of an engine system or another controller capable communication with an ECM.

Controller 90 is configured to receive analog or digital signals from at least one sensor 94. As described above, for example, a WHR system according to the present disclosure can include one or more temperature, pressure, oil presence, and/or oil level sensors, which are collectively represented in FIG. 5 as sensor 94. Based on at least one received signal from sensor 94, controller 90 determines a control signal and provides the control signal to an actuator 96, which can be, for example, an actuator associated with flow device 80 or flow device 84 to control an amount the fluid flow through the device. For example, an embodiment a module can monitor engine operation over various power ranges and measure an amount of time the engine is operated within each range. Using this information, controller 90 can use, for example, a look up table to determine whether to open or close flow control device 80 or 84.

It will be recognized that in each of the embodiments, the various control actions could be performed by specialized circuits (e.g., discrete logic gates interconnected to perform a specialized function), by program instructions (software), such as logical blocks, program modules etc. being executed by one or more processors (e.g., one or more microprocessor, a central processing unit (CPU), and/or application specific integrated circuit), or by a combination of both. For example, embodiments of controller 90 can be implemented in hardware, software, firmware, middleware, microcode, or any combination thereof.

Programmed instructions can be program code or code segments that perform necessary tasks and can be stored in memory 92, which is a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

Memory 92 can be considered to be embodied within any tangible form of computer readable carrier, such as solid-state memory, magnetic disk, and optical disk containing an appropriate set of computer instructions, such as program modules, and data structures that would cause a processor to carry out the techniques described herein. A machine-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having a controller 90 that performs one or more particular functions. It should be understood that this controller is merely schematically illustrated based on its function for clarity purposes, and does not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Figure 6:
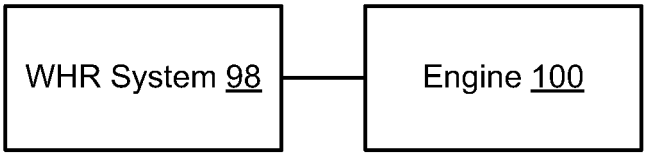
FIG. 6 is a diagram of an internal combustion engine coupled to a waste heat recovery system according to an exemplary embodiment.

The embodiments described herein can be used in any combination or all combined into one combination to reduce oil concentration in the working fluid to a desired level in a WHR system. For example, while not shown in FIG. 3, conduit 20*c* also can include an oil scraper 22 as described above with respect to the embodiment shown in FIG. 1. Further, as shown in FIG. 6, any of the above embodiments or combinations thereof, represented by WHR system 98 can be coupled with a component of an internal combustion engine 100, for example, a driveline component such as a crankshaft of engine 100 to supplement the engine's power. While not shown in FIG. 6, additional components can be included in embodiments consistent with the present disclosure, for example, there can be additional gears to provide the power to the driveline of the engine 100, or a belt drive. In another embodiment, WHR system 98 can be coupled with a component of an internal combustion engine 100 electrically, for example, with an alternator and motor.

Although a limited number of exemplary embodiments are described herein, those skilled in the art will readily recognize that there could be variations, changes and modifications to any of these embodiments, or combinations of these embodiments, and those variations would be within the scope of this disclosure. For example, while the embodiments shown in FIGS. 3 and 4 are described as having actively controlled flow control devices, these embodiments can also be implemented using a passive control configuration and method. For example, flow control can be achieved using thermostats based on temperature of oil or working fluid, or based on a predetermined pressure difference opening a spring loaded valve, or simply by using a restrictive orifice.

What is claimed is:

1. A waste heat recovery system configured to be operatively coupled to an internal combustion engine, the waste heat recovery system comprising:

a Rankine cycle (RC) circuit operable to convert heat energy of the internal combustion engine, said RC circuit including a pump, a boiler, an energy converter, a condenser, and a conduit fluidly connecting the energy converter and the condenser;

a gear assembly mechanically coupled to the energy converter, said gear assembly including a capacity for oil;

an interface positioned between the RC circuit and the gear assembly; and an oil collector positioned in the conduit between the energy converter and the condenser, wherein the waste heat recovery system is structured to return, due to a first pressure of oil proximate the oil collector being higher than a second pressure of oil proximate the gear assembly due to a dynamic pressure of the oil proximate the oil collector, oil that has moved across the interface from the gear assembly to the RC circuit.

2. The waste heat recovery system according to claim 1, wherein the oil collector comprises:

a port in an interior of the conduit between the energy converter and the condenser; and a channel formed in an inner wall of the conduit and having one end distal to the port and another end proximal to the port.

3. The waste heat recovery system according to claim 1, further comprising an oil return line fluidly connected to the oil collector and operable to return to the gear assembly oil that has moved across the interface from the gear assembly to the RC circuit.

4. The waste heat recovery system according to claim 3, further comprising:

a flow control device positioned in a path of the oil return line;

a sensor adapted to sense a characteristic of the waste heat recovery system and generate a signal indicative of the sensed characteristic; and a controller to cause the flow control device to open based on a comparison of the generated signal with a predetermined condition.

5. The waste heat recovery system according to claim 4, wherein the predetermined condition is at least one of a threshold value corresponding to a sensed pressure at an inlet of the energy converter, a threshold value corresponding to a sensed temperature at the inlet of the energy converter, a threshold value corresponding to an oil temperature, whether presence of oil is detected, and a threshold value corresponding to sensed time spent at a particular engine operating condition.

6. The waste heat recovery system according to claim 1, wherein the gear assembly includes an input shaft mechanically coupled to the energy converter and the interface is a seal for the input shaft.

7. The waste heat recovery system according to claim 1, further comprising:

a vent positioned at the gear assembly;

a working fluid vapor return line fluidly connected between the vent and the conduit fluidly connecting the energy converter to the condenser; and a check valve in the working fluid vapor return line configured to prevent back flow of working fluid vapor into the gear assembly from the conduit fluidly connecting the energy converter to the condenser.

8. A waste heat recovery system, comprising:

a Rankine cycle (RC) circuit operable to convert heat energy of a waste heat source, said RC circuit including a boiler fluidly connected to a pump downstream of the pump, an energy converter fluidly connected to the boiler downstream of the boiler, a condenser fluidly connected to the energy converter downstream of the energy converter and fluidly connected to the pump upstream of the pump, each fluid connection between the boiler, pump, energy converter and condenser comprising a conduit;

a gear assembly mechanically coupled to the energy converter, said gear assembly including a capacity for oil;

an interface positioned between the RC circuit and the gear assembly;

an oil collector positioned in the conduit between the energy converter and the condenser; and an oil return line fluidly connected to the oil collector and operable to return to the gear assembly, due to a first pressure of oil proximate the oil collector being higher than a second pressure of oil proximate the gear assembly due to a dynamic pressure of the oil proximate the oil collector, oil that has moved across the interface from the gear assembly to the RC circuit.

9. The waste heat recovery system according to claim 8, wherein the gear assembly includes an input shaft mechanically coupled to the energy converter and the interface is a seal for the input shaft.

10. The waste heat recovery system according to claim 8, wherein the oil collector is positioned proximate a bend in the conduit between the energy converter and the condenser.

11. The waste heat recovery system according to claim 8, wherein the oil collector comprises:

a port providing a passageway between an interior of the conduit between the energy converter and the condenser; and a channel formed in an inner wall of the conduit configured to flow the working fluid and having one end distal to the port and another end proximal to the port;

wherein the oil return line is fluidly connected between the oil collector and the gear assembly.

12. The waste heat recovery system according to claim 8, wherein the oil collector comprises a channel structure comprising at least one channel that extends along a path that intersects a tangential fluid flow path in the conduit between the energy converter and the condenser, the at least one channel configured to collect and guide oil on an inner wall of the conduit through an opening of the oil collector.

13. The waste heat recovery system according to claim 12, wherein the at least one channel is at least two channels.

14. The waste heat recovery system according to claim 8, further comprising:

a flow control device positioned in the path of the oil return line;

a sensor adapted to sense a characteristic of the waste heat recovery system and generate a signal indicative of the sensed characteristic; and a controller operable to cause the flow control device to open based on a comparison of the generated signal with a predetermined condition.

15. The waste heat recovery system according to claim 14, wherein the predetermined condition is at least one of a threshold value corresponding to a sensed pressure at an inlet of the energy converter, a threshold value corresponding to a sensed temperature at the inlet of the energy converter, a threshold value corresponding to an oil temperature, whether presence of oil is detected, and a threshold value corresponding to sensed time spent at a particular engine operating condition.

16. The waste heat recovery system according to claim 8, further comprising:

a flow control device positioned in the oil return line and operable to control an amount of oil flow in the oil return line;

a sensor adapted to sense a characteristic of the waste heat recovery system and generate a signal indicative of the sensed characteristic; and a controller operable to cause the flow control device to open based on a comparison of the generated signal with a predetermined condition.

17. The waste heat recovery system according to claim 16, wherein the predetermined condition is at least one of a threshold value corresponding to a sensed pressure at an inlet of the energy converter, a threshold value corresponding to a sensed temperature at the inlet of the energy converter, a threshold value corresponding to a sensed oil temperature, whether presence of oil is detected, a threshold value corresponding to a sensed oil level in the oil collector, a threshold value corresponding to sensed time spent at a particular engine operating condition.

18. The waste heat recovery system according to claim 8, wherein the oil return line is fluidly connected to the conduit fluidly connecting the pump to the boiler.

19. The waste heat recovery system according to claim 8, wherein the gear assembly includes a gearbox including an input shaft and an output shaft, and the gearbox has a reduction ratio that causes the output shaft to have a rotational speed reduced and a torque increased relative to a speed and torque of the input shaft.

20. The waste heat recovery system according to claim 8, further comprising:

a vent positioned at the gear assembly;

a working fluid vapor return line fluidly connected between the vent and the conduit fluidly connecting the energy converter to the condenser; and a check valve in the working fluid vapor return line configured to prevent back flow of working fluid vapor into the gear assembly from the conduit fluidly connecting the energy converter to the condenser.

* * * * *